United States Patent [19]

Lehmann

[11] 4,011,666

[45] Mar. 15, 1977

[54] SOLE PATTERN FOR SHOES

[75] Inventor: Gerhard Karl Lehmann, Vordingborg, Denmark

[73] Assignee: A/S Jac. Engelbredt, Vordingborg, Denmark

[22] Filed: Aug. 21, 1975

[21] Appl. No.: 606,526

[30] Foreign Application Priority Data

June 27, 1975 Germany ..... 7520546

[52] U.S. Cl. ..... 36/59 C

[51] Int. Cl.[2] ..... A43B 23/28

[58] Field of Search ..... 36/32 R, 25 R, 59 R, 36/59 C

[56] References Cited

UNITED STATES PATENTS

| | | | |
|---|---|---|---|
| 1,229,278 | 6/1917 | Johnson | 36/59 R |
| 2,981,011 | 4/1961 | Lombardo | 36/59 C |
| 3,018,571 | 1/1962 | Doherty | 36/59 C |
| 3,507,059 | 4/1970 | Vietas | 36/32 R |

*Primary Examiner*—Patrick D. Lawson

*Attorney, Agent, or Firm*—John J. Dennemeyer

[57] ABSTRACT

A sole pattern for shoe soles of elastic yielding material comprises projections whose cross-section decreases in a direction at right angles away from the sole. The projections are associated as projection couples in such a way that the tread surface of one projection is sloped inwardly toward the sole and the tread surface of the other projection is also sloped inwardly toward the sole, while the component of the inclination on a level of the sole is oppositely directed.

6 Claims, 7 Drawing Figures

SOLE PATTERN FOR SHOES

The invention relates to a sole pattern for shoe soles of an elastic yielding material whose cross-section decreases in a direction at right angles away from the sole. Such sole patterns are used for example in shoes which must be highly non-skid, for instance in the engine rooms of ships or on board yachts. In the development of such non-skid patterns for soles of shoes the same precepts or principles apply fundamentally to their construction as to the development of car tires. In this connection it is important that water or other liquid which might be on the support on which persons walk, can escape through the grooves of the pattern at a suitable velocity, so that the rises of the pattern can get into frictional contact with the support. In this connection it is not easy to explain by the laws of physics, why one pattern is better than an other.

The characteristic feature of the pattern according to the invention consists in providing couples of projections wherein two projections are associated in such a way that the tread or upper surface of one projection is sloped inwardly toward the sole, and the tread or upper surface of the other projection is likewise sloped inwardly toward the sole, but wherein the component of the inclination on a level of the sole is oppositely directed. In such a construction it has proved that a non-skid quality exceeding that of other sole patterns can be achieved.

Figure 2:
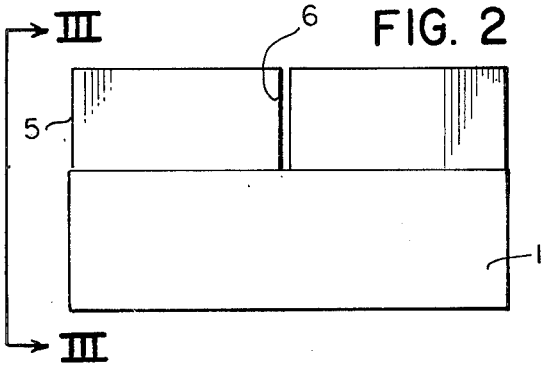
Figure 3:
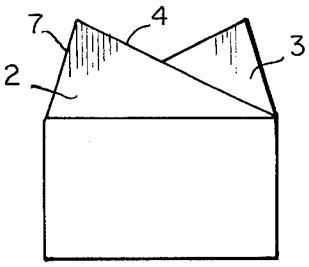
Figure 1:
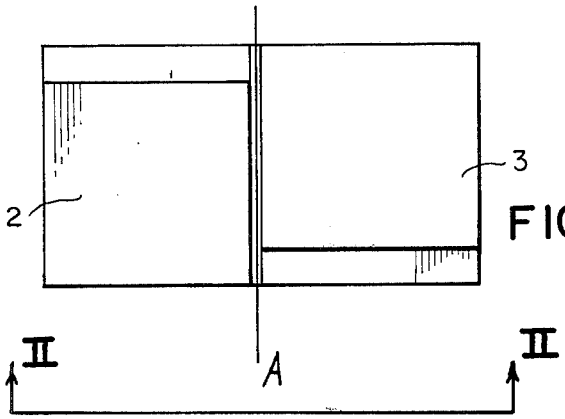
Figure 5:
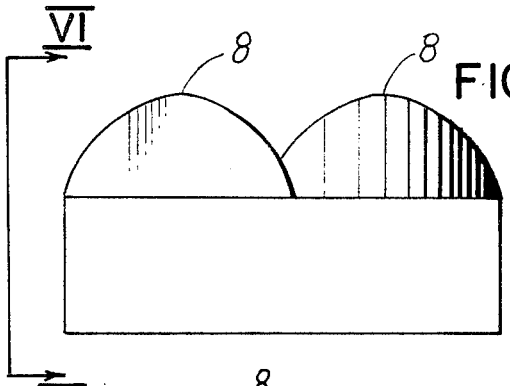
Figure 6:
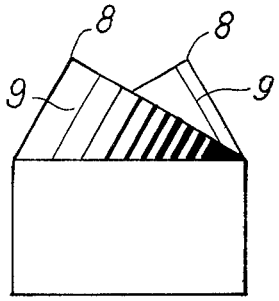
Figure 4:
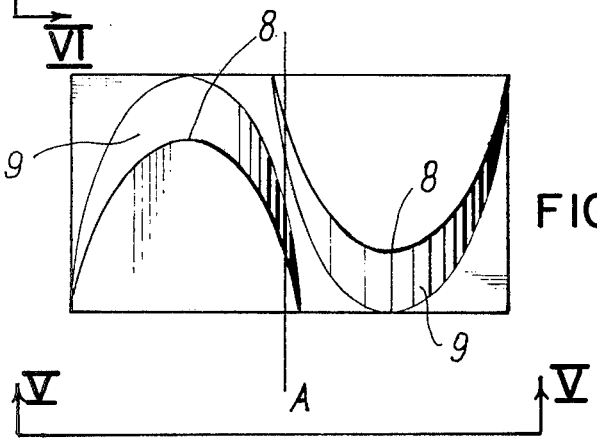
Figure 7:
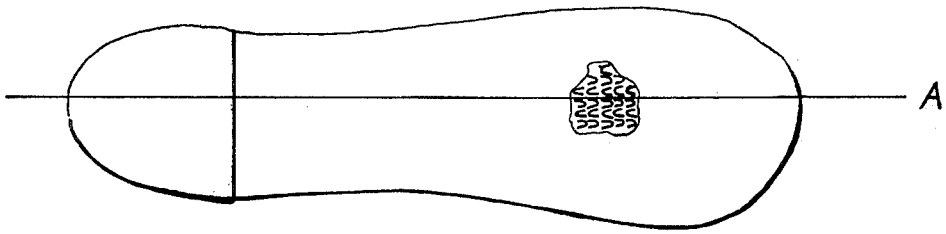

The invention will be further explained below with reference to the accompanying drawing, in which FIG. 1 illustrates a rectangular section of a shoe sole pattern of one embodiment of the invention, as viewed at right angles to the level of the sole, FIG. 2 illustrates the same sole pattern viewed in the direction of the arrows II—II in FIG. 1, FIG. 3 illustrates the same sole pattern viewed in the direction of the arrows III—III in FIG. 2, FIG. 4 illustrates a rectangular section of a sole pattern according to another embodiment of the invention, as viewed at right angles to the level of the sole, FIG. 5 illustrates the same sole pattern viewed in the direction of the arrows V—V in FIG. 4, FIG. 6 illustrates the same sole pattern viewed in the direction of the arrows IV—IV in FIG. 5, and FIG. 7 illustrates a shoe sole viewed from below, in which the pattern of FIG. 4, 5 and 6 is shown diagrammatically.

FIGS. 1, 2 and 3 show a section of a shoe sole with a pattern according to the invention in double-rectangular illustration. A section 1 of a sole is provided with a couple of projections 2 and 3 which are uniform but turned 180° in relation to each other about an axis at right angles to the level of the sole, i.e. at right angles to the level of the paper in FIG. 1. The height of the pattern in relation to the thickness of the sole is highly exaggerated, i.e. the sole is in reality somewhat thicker than shown. The surface which will function as a tread at the projection 2 is an inclined, rectangular surface 4. However, only the upper part of this surface will function as a tread. The other sides of the projection are formed by two vertical sides 5 and 6 which, in practice, must have some slip away from the level of the sole, and a further inclined, rectangular surface 7, which forms an angle of up to 90° with the level of the sole.

FIGS. 4, 5 and 6 illustrate correspondingly another preferred embodiment, in which the inclined treads of the projections are parabolic with the vertex of the parabola-like form situated at the highest point of the projection. These points are indicated by numeral 8. The other part of a projection according to this embodiment is made up of a lateral surface 9 which is nearly cylindrical, yet not circularly cylindrical, and which has a slip in the direction away from the sole.

In the Figures is indicated a direction A, which is a longitudinal direction of a sole as shown in FIG. 7.

It has been found that when the preferred embodiment of the pattern as shown in FIGS. 4, 5 and 6 is oriented as shown in FIG. 7, a sole with a high grade of non-skid is provided, and one which easily lets go of dirt in the form of pebble and gravel particles. The real cause of the high friction offered by the sole according to the invention cannot be demonstrated as a matter of course, especially on a wet or smooth support. It is assumed that the two oppositely directed inclined treads, which are situated next to each other, constitute the essential element of the invention such as explained and defined above.

It is obvious that the shape of the lateral faces of the projections can be substantially varied within the scope of the invention.

What is claimed is:

1. A sole pattern for shoe soles of elastic yielding material, comprising: a plurality of rows of projections extending across said sole generally perpendicular to the longitudinal axis of the sole, each of said rows comprising a plurality of pairs of separate, spaced projections whose cross section decreases in a direction at right angles away from the sole, wherein the two projections of each pair are associated in such a way that the tread surface of one projection is sloped inwardly toward the sole and lies in an inclined plane extending transversely of the sole, and the tread surface of the other projection is also sloped inwardly toward the sole and lies in a second inclined plane extending transversely of the sole, said first and said second mentioned inclined planes being oppositely directed, and the tread surface of each projection being defined by a pair of side faces, and an end face that meets the tread surface to form an apex, at least said end face being inclined inwardly relative to a plane extending normally from the surface of said sole.

2. A sole pattern according to claim 1, wherein said inclined surface of a projection is rectangular.

3. A sole pattern according to claim 2, wherein the other sides of a projection are mainly plane surfaces at right angles to the level of the sole.

4. A sole pattern according to claim 3, wherein said side faces of each projection are also inwardly inclined relative to a plane extending normally from the surface of said sole.

5. A sole pattern according to claim 1, wherein the said inclined surface of each projection is parabolic with the vertex situated at the highest point of the projection, and the side faces and end face of the projection are all inwardly inclined.

6. A sole pattern according to claim 1, wherein the said inclined, upper treads form an angle with the level of the sole of 30° – 60°.

* * * * *